US008662353B2

(12) United States Patent
Santoni et al.

(10) Patent No.: US 8,662,353 B2
(45) Date of Patent: Mar. 4, 2014

(54) PROTECTIVE CAP FOR DISPENSERS AND CONTAINER COMPRISING SAID CAP

(75) Inventors: Giorgio Santoni, Spoltore (IT); Fabrizio Camplone, Pescara (IT)

(73) Assignee: Emsar S.p.A., San Giovanni Teatino (CH) (IT)

( * ) Notice: Subject to any disclaimer, the term of this patent is extended or adjusted under 35 U.S.C. 154(b) by 781 days.

(21) Appl. No.: 12/408,878

(22) Filed: Mar. 23, 2009

(65) Prior Publication Data

US 2009/0255958 A1 Oct. 15, 2009

(30) Foreign Application Priority Data

Apr. 9, 2008 (IT) ..... RM2008A0186

(51) Int. Cl.
*B67D 7/06* (2010.01)

(52) U.S. Cl.
USPC ..... 222/182; 222/321.9; 222/556

(58) Field of Classification Search
USPC ..... 222/153.1, 182, 321.1, 556, 321.7, 222/321.9; 215/235, 237
See application file for complete search history.

(56) References Cited

U.S. PATENT DOCUMENTS 3,148,805 A * 9/1964 Cooprider et al. ..... 222/384
3,606,104 A * 9/1971 Rickmeier, Jr. ..... 222/498
4,353,483 A * 10/1982 Pehr ..... 222/153.02
4,911,324 A * 3/1990 Dubach ..... 220/838
5,251,793 A * 10/1993 Bolen et al. ..... 222/546
5,335,802 A * 8/1994 Brach et al. ..... 215/235
7,073,679 B1 * 7/2006 Lagler et al. ..... 220/259.1
7,510,095 B2 * 3/2009 Comeau et al. ..... 215/321
2002/0148860 A1 * 10/2002 Cohen et al. ..... 222/321.7
2006/0011660 A1 * 1/2006 Sandlin ..... 222/321.9

* cited by examiner

*Primary Examiner* — Daniel R Shearer
(74) *Attorney, Agent, or Firm* — Young & Thompson

(57) ABSTRACT

A container comprises a dispensing head (13) and a protective cap (1) fitted on the dispensing head (13). The cap (1) comprises a base portion (1*a*) engageable to a dispensing head (13); a lid (1*b*) hinged to said base portion (1*a*) and movable between an open position, in which it allows access to the dispensing head (13), and a closed position in which it prevents access to the dispensing head (13); an outer locator plate (9) engageable with a corresponding inner locator plate (24) of said dispensing head (13), the mutual engagement between said locator plates (9, 24) defining a screwing motion of the cap (1) relative to the dispensing head (13) to automatically achieve an installation of the cap (1) on the dispensing head (13) according to a pre-determined mutual angular positioning. The dispensing head (13) comprising a base (14) able to be coupled stably to an outlet portion of the container; a dispenser (15) having a dispensing head and slidably movable relative to the base (14) to obtain a dispensing of a product contained in the container as a result of a pressure exerted on the dispenser (15); at least one inner locator plate (24) engageable with the outer locator plate (9) of the cap (1), to guide the outer locator plate (9) according to a helical path around the dispenser (15).

3 Claims, 4 Drawing Sheets

FIG 2a
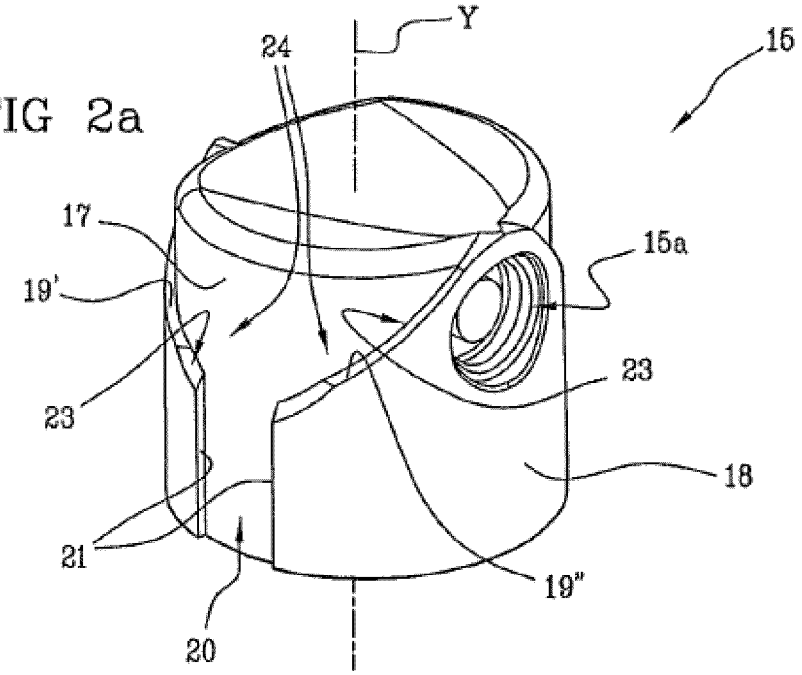
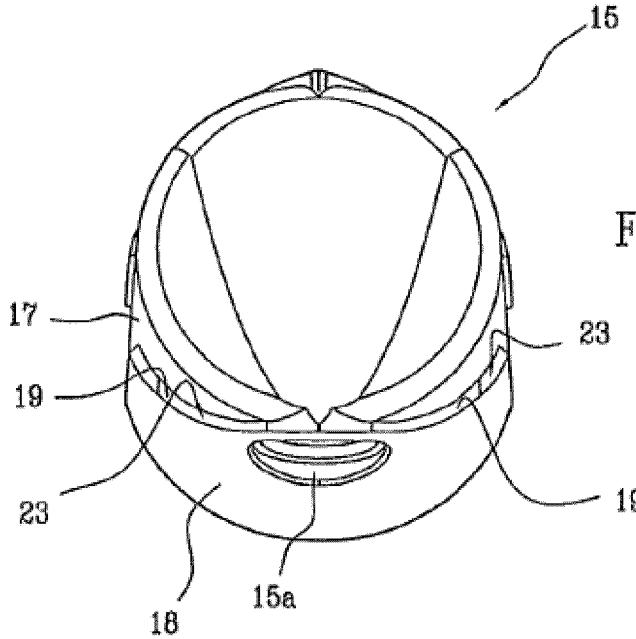
FIG 2b

PROTECTIVE CAP FOR DISPENSERS AND CONTAINER COMPRISING SAID CAP

BACKGROUND OF THE INVENTION

The present invention relates to a protective cap for dispensers. More in particular, the present invention relates to a protective cap for dispensers of liquids under pressure such as atomisers, micro-pumps or similar devices with a pressure-operated plunger. By way of example, dispensers of the type described above are applied to containers of perfumes, lotions, detergents or cosmetics in general.

The invention further relates to a container containing said cap.

Currently known are containers lacking a cap and provided with a spray dispenser in which the dispenser can be brought to assume a blocking position by rotating an external actuating element around a longitudinal axis of the container. Containers of this type, described for example in EP Patent 952892, have the drawback of requiring complex articulated mechanisms able to achieve the locking of the plunger of the dispenser as a result of the rotation of the actuator member. Moreover, the operation of containers of the type described above requires using two hands, one to grip the container and the other one to rotate the actuator member. Hence, they are unsuitable to be operated in situations of constrained freedom of movement, e.g. when the user has one hand busy as is often the case whilst driving a vehicle, whilst writing or in other similar situations.

Also widely used are protective caps in the form of removable hoods, able to be coupled in snap-on fashion on a container at the dispenser to prevent impacts or accidental pressures on the plunger of the dispenser from causing undesired spills of the product present in the container. Such hoods generally have cylindrical conformation and completely envelop the dispenser.

These hoods, widely used, have the drawback of remaining uncoupled from the container during the dispensing operation and hence they can easily be misplaced. Moreover, in this case too the removal of such hoods requires use of two hands, one to grip the container and the other to separate the hood from the container. Hence, they too are unsuitable to be operated in situations of constrained freedom of movement for the user.

Also known are protective caps, of the type described in U.S. Pat. No. 4,805,790, stably connected to a container and pivoting around an axis of rotation to reach a dispensing position in which they allow the product present in the container to be dispensed. In particular, U.S. Pat. No. 4,805,790 describes a cap that can be coupled directly to an outlet mouth of a container, and the container is of the type able to dispense the product by the crushing of the container itself, and not by pressure exerted on a plunger. Disadvantageously, this cap is therefore not applicable to dispensers having a plunger for dispensing a liquid under pressure.

Lastly, from the document U.S. Pat. No. 5,180,084, a dispenser is known which has a dispensing plunger actuated by a translator that can be pressed directly by a user, and equipped with a flip-top cap pivotable on the top of the container between a position covering the dispenser and a position closing the dispenser. Disadvantageously, the complexity of this dispenser requires complex operations for mounting it on the respective container, linked mostly to the need to align the lid with a respective hinging portion of the container. Moreover, the plunger is able to dispense the product along its translation direction, whilst the dispenser does not seem suited to dispense the product in all directions, e.g. a horizontal direction.

SUMMARY OF THE INVENTION

The technical task of the present invention is to make available a protective cap for dispenser that is free of the aforementioned drawbacks.

Within said technical task, a main object of the invention is to make available a protective cap for dispenser that can be applied simply and rapidly on the respective container.

An additional object of the invention is to make available a protective cap for dispensers that can be applied to spray dispensers such as atomisers, micro-pumps and the like, preferably also of the type able to dispense the product along directions transverse to the direction of translation of the plunger.

Moreover, an object of the invention is to make available a protective cap for dispensers that can be operated in a very simple manner and hence even in hardship situations.

These objects and others besides, as shall be readily apparent in the remainder of the present description, are substantially achieved by a protective cap for dispensers having the characteristics expressed in claims 1 and 14 and/or in one or more of the claims that depend thereon.

According to an additional aspect of the invention, also proposed are a dispenser head and a container comprising the aforesaid cap and dispenser head, respectively in accordance with claims 6 and 22 and/or with one or more of the claims that depend thereon.

Additionally, according to a further aspect of the invention, a method is proposed for assembling the aforesaid container, in accordance with claim 26 and/or with one or more of the claims that depend thereon.

BRIEF DESCRIPTION OF THE DRAWINGS

By way of non limiting example, a preferred but not exclusive embodiment shall now be illustrated of a protective cap for dispensers in accordance with the present invention and with the accompanying figures, in which:

FIGS. 2*a* and 2*b* show two perspective views from different angles of a dispenser able to be coupled to the cap of FIG. 1;

DESCRIPTION OF THE PREFERRED EMBODIMENT

Figure 1:
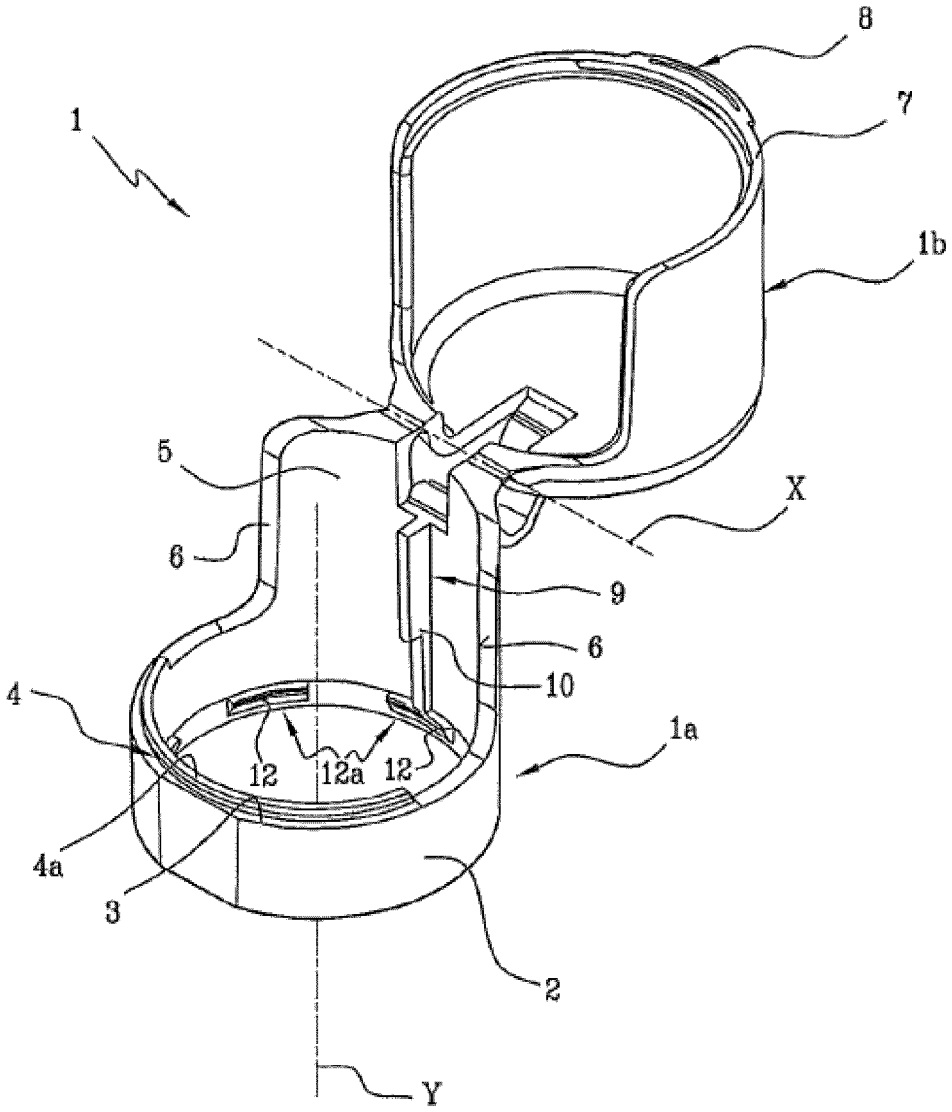
FIG. 1 shows a perspective view of a protective cap for dispensers according to the present invention.

In accordance with the accompanying figures, the reference number 1 indicates a protective cap for dispensers according to the present invention.

The cap 1 comprises a base portion 1*a* and a lid 1*b* hinged to the base portion 1*a* to rotate around an axis of rotation "X". In particular, the lid 1*b* is movable between a closed position, in which it abuts the base portion 1*a* to close a space internal to the cap 1, and an open position in which it is rotated to allow access to the space internal to the cap 1.

The base portion 1*a* comprises a cylindrical body 2 that develops around an axis "Y" and has substantially axial-symmetrical conformation relative to said axis "Y". The cylindrical body 2 presents an abutment surface 3 having a planar or substantially planar lay, which can be abutted by the lid 1*b* when the latter is in the closed position. The abutment surface 3 is equipped with coupling means 4 stably engageable by a corresponding portion of the lid 1*b* to keep the lid 1*b* in the closed position. The coupling means 4 preferably comprise snap-in means such as a deformable projection 4*a* extending away from the abutment surface 3, and they can be released to allow the lid 1*b* to be opened and stably closed again an indefinite number of times.

The base portion 1*a* further comprises a hinging portion 5 which extends away from the abutment surface 3 defining an extension of the cylindrical body 2, in other words it extends according to the direction of the "Y" axis around which the cylindrical body 2 develops. The hinging portion 5, which is positioned diametrically opposite to the abutment surface 3, is hinged at the top to the lid 1*b* and, in this configuration, the axis of rotation "X" is positioned in the topmost portion of the entire base portion 1*b*. In other words, the abutment surface 3 is lowered relative to the hinging portion 5.

The hinging portion 5 presents a contact edge 6, also able to be abutted by the lid 1*b* when the latter is in the closed position, such as to obtain a sealing profile that extends along the entire peripheral development of the lid 1*b*. In particular, the aforesaid sealing profile is defined by the aforesaid abutment surface 3 and by two mutually opposite contact edges 6 and it delimits within it an opening providing access to the space within the cap 1.

Figure 3:
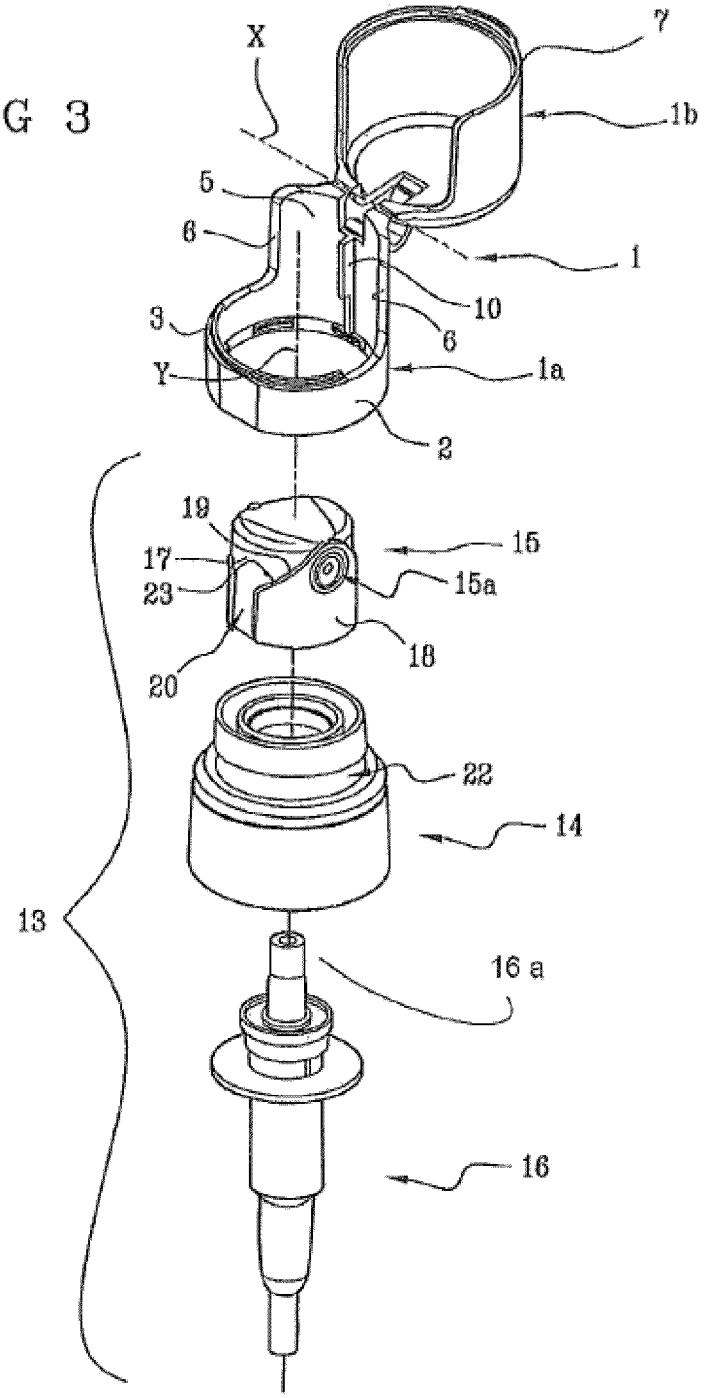
FIG. 3 shows an exploded view of a dispensing unit comprising the cap and the dispenser of FIGS. 1 and 2*a*-2*b;*

As shown in FIGS. 1 and 3, the lid 1*b* assumes a substantially cylindrical or tubular conformation and it has a lower edge 7 that is shaped in substantially complementary fashion with respect to the aforesaid abutment surface 3. The lid 1*b* also presents a protrusion 8 which projects from the aforesaid lower edge 7 and also projects from the abutment surface 3 (towards the exterior of the cap 1) when the lid 1*b* is in the closed position, in such a way that said protrusion 8 can easily be intercepted by a user's finger to open the lid 1*b*.

As shown in FIG. 1, the base portion 1*a* presents a locator plate 9 defined by a projection 10 extending towards the aforesaid "Y" axis around which the cylindrical body 2 develops. The projection 10 is borne by the hinging portion 5 and it has a prevalent direction of development parallel to the aforesaid "Y" axis.

The base portion 1*a* further comprises a plurality of radial projections 12 which extend away from a lower edge of the cylindrical body 2 and have a prevalent direction of development lying on a substantially circular path around the "Y" axis.

The exploded view of FIG. 3 shows a dispensing head, indicated in its entirety with the reference number 13, according to the present invention and able to be coupled stably to the protective cap 1 described previously.

The dispensing head 13 comprises:

- a base 14, able to be stably coupled to an output portion of a container, e.g. by screwing;
- a suction member 16, mounted inferiorly to the base to convey the fluid contained in the container towards a dispensing conduit 16*a;*
- a dispenser 15, slidably mounted on the dispensing conduit 16*a* and provided with a dispensing outlet 15*a* to dispense the fluid contained in the container as a result of a pressure exerted on the dispenser 15.

Figure 4:
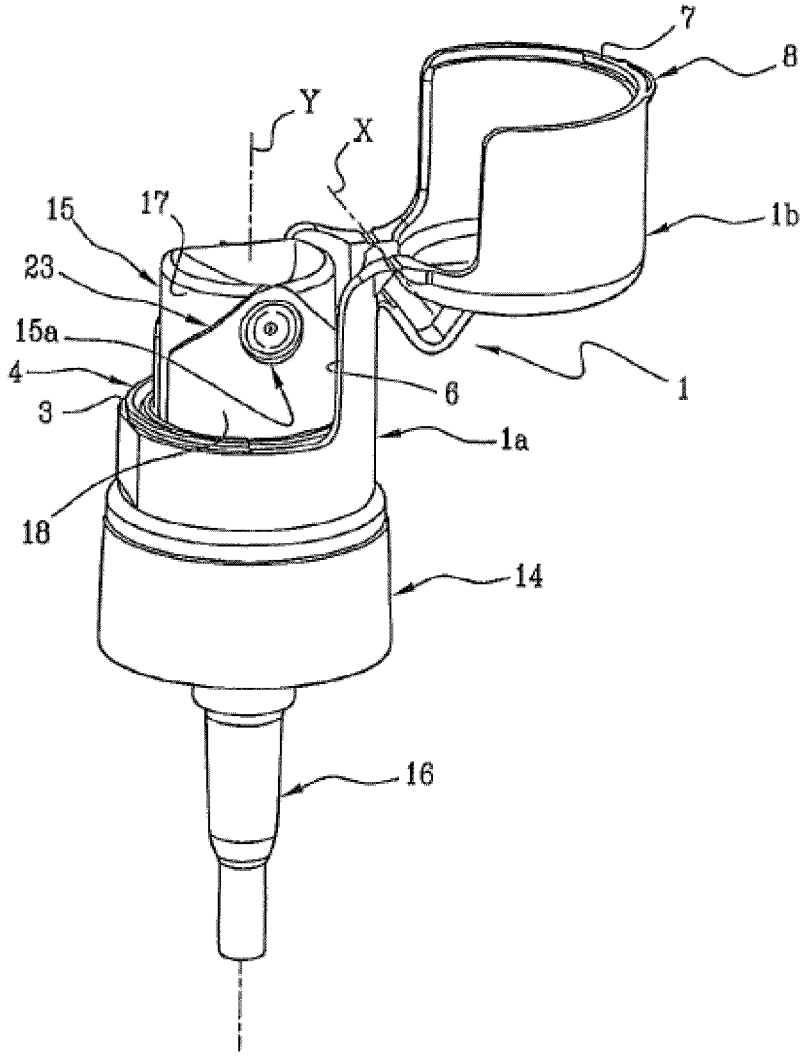
FIG. 4 shows a perspective view of the dispensing unit of FIG. 3 in assembled configuration.

As is more clearly visible in FIGS. 2*a* and 2*b*, the dispenser 15 presents a substantially cylindrical external conformation developing around an axis which, in a mounted configuration of the type shown in FIG. 4, substantially coincides with the aforesaid axis "Y".

The dispenser 15 presents a first surface 17 defining a segment of a cylindrical surface with circular section which develops around the aforesaid "Y" axis, and it further comprises a second surface 18 defining a segment of an additional cylindrical surface with circular section, also developing around the aforesaid "Y" axis. The first surface 17 has smaller radius than the second surface 18 and the aforesaid surfaces 17, 18 co-operate to define substantially the outer contour of the dispenser 15. As is readily apparent from FIGS. 2*a*, 2*b*, they are mutually joined by shoulders 19 transverse to the aforesaid surfaces 17, 18. Each shoulder 19 develops according to a helical path around a direction of translation of the dispenser 15, i.e. around the aforesaid "Y" axis. In other words, each should 19 develops according to a direction that screws around the aforesaid "Y" axis.

In the preferred and illustrated embodiment, there are four shoulders 19, coupled in twos and each pair of shoulders 19 is positioned orthogonally opposite to the dispensing outlet 15*a*. In greater detail, the two shoulders 19', 19" of each pair face each other and define respective paths, mutually converging relative to a direction of approach of the cap 1 to the dispenser 15. Said paths converge, in particular, towards an area of stable coupling 20 (whose function shall be described below) which is laterally delimited by a pair of parallel shoulders 21, defining extensions of respective shoulders 19 of each pair and preferably aligned to the aforesaid "Y" axis.

According to one manner of mounting the cap 1 on the dispenser head 13 (FIGS. 3 and 4), the base 14 comprises an annular seat 22 stably engageable in snap-in fashion by the aforesaid radial projections 12 for the base portion 1*a* of the cap 1, which therefore define means 12*a* providing stable connection between cap 1 and dispensing unit 13, preferably of non releasable type. In mounted configuration, the cylindrical body 2 of the cap 1 envelops at least partially the base 14 and the dispenser 15 is contained in the space within the cap 1. The movement of the lid 1*b* then allows access to the underlying dispensing unit 13 as well as a protection thereof, because in the closed position the lid 1*b* prevents access to the dispensing unit.

The aforesaid shoulders 19 also define respective guiding surfaces 23 able to be engaged by bearing relationship by the locator plate 9 of the cap 1, i.e. by the projection 10 of the base portion 1*a*. Hence, the guiding surfaces 23 of the dispenser 15 constitute an inner locator plate, engageable with the locator plate 9 of the cap 1 (hence defining a corresponding outer locator plate).

More in detail, as soon as the cap is fitted on the dispensing unit 13, the projection 10 can be directly positioned aligned to the underlying stable coupling area 20, and hence the insertion of the cap 1 takes place by simple translation of the cap 1. Alternatively, if said alignment condition does not take place, the projection 10 intercepts one of the four guiding surfaces 23 which guides the projection 10 along the helical path defined by the guiding surface 23 itself. The cap 1 is then brought to follow a helical trajectory around the axis "Y" and, hence, it undergoes a screwing motion around the dispenser 15 until the projection 10 reaches the stable coupling area 20. At this point, the cap 1 drops further and it can be pushed until the radial projections 12 are irreversibly engaged in snap-in fashion in the annular seat 22 of the base 14. Once this configuration is reached, the base portion 1*a* is rotationally integral with the dispenser 15 and hence the mutual angular positioning is determined permanently.

The present invention achieves the proposed objects, overcoming the drawbacks of the prior art.

The presence of the aforesaid inner locator plate (on the dispenser) and outer locator plate (on the cap) enables to mount the cap automatically, and in particular also arranging the cap and the dispenser according to a random angular positioning. The presence of the guiding locator plates automatically guides the cap, which can be left free to rotate and hence slide on the guiding surfaces until assuming the correct orientation relative to the dispenser.

The particular conformation of the cap and of the hinging portion enables, in the first place, to open the lid of the cap with just a finger, e.g. with the thumb of one hand, whilst gripping the container with the same hand. Advantageously, moreover, the top position of the axis or rotation of the lid causes the rotated lid not to interfere with the dispensing head (13) and in particular with the dispenser (15), projecting above said dispensing head (13). Otherwise, the opening operation would be prevented by the collision between the lid (1*b*) and the dispenser (15).

In the second place, the position of the pairs guiding surfaces facing each other (the two pairs are positioned orthogonally opposite the dispensing outlet) enables always to have the projection of the cap positioned laterally to the dispensing outlet, which is thus always positioned towards one side of the cap. The resulting advantage is that whilst the thumb of the hand lifts the cap, the index finger of the same hand can easily press the dispenser. In according to the view of FIG. 4, this can be achieved with a user's left hand.

What is claimed is:

1. Device for dispensing fluids, comprising:

a dispensing head comprising:

i) a base able to be coupled stably to an outlet portion of a container;

ii) a dispenser having a dispensing outlet and slidably movable relative to the base to dispense a product contained in the container as a result of a pressure exerted on the dispenser;

wherein the dispenser presents a substantially cylindrical external conformation developing around an axis and also presents a first surface, defining a segment of a cylindrical surface with circular section which develops around said axis, and a second surface, defining a segment of an additional cylindrical surface with circular section also developing around said axis, the first surface having smaller radius than the second surface and said surfaces co-operating to define an outer contour of the dispenser, wherein the two said surfaces are mutually joined by four shoulders transverse to said surfaces, each shoulder developing according to a helical path around said axis and defines a guiding surface developing according to a helical path around said axis, and wherein said four shoulders are coupled in twos and each pair of shoulders has an angular position, around said axis, which is orthogonal with respect to the dispensing outlet of the dispenser;

and a protective cap designed to be applied on said dispensing head and comprising:

i) a base portion engageable to said dispensing head and presenting a hinging portion and a cylindrical body developing around a respective axis, said hinging portion being raised from the cylindrical body;

ii) a lid hinged to said hinging portion to rotate around an axis of rotation between an open position, in which the lid allows access to the dispensing head, and a closed position in which the lid prevents access to the dispensing head; and iii) one outer locator plate engageable with any of said pair of shoulders of said dispensing head, wherein said outer locator plate is borne by the hinging portion of said base portion and is defined by a projection extending towards the axis around which the cylindrical body of the base portion develops, and wherein the mutual engagement between said outer locator plate and any of said pair of shoulders defines a screwing motion of the protective cap relative to the dispensing head to achieve automatically an installation of the protective cap on the dispensing head according to a pre-determined mutual angular positioning, wherein the protective cap is applied to the dispensing head with the hinging portion placed laterally with respect to the dispensing outlet of the dispensing head.

2. Container as claimed in claim 1, wherein said outer locator plate and said shoulders are so shaped as to guide the cap automatically during an approach of the cap to the dispenser to make the cap assume said pre-determined angular positioning.

3. Container as claimed in claim 1, wherein said outer locator plate and any of said pair of shoulders are mutually engaged by bearing relationship.

* * * * *